United States Patent [19]

Kajikawa et al.

[11] Patent Number: 4,493,381

[45] Date of Patent: Jan. 15, 1985

[54] TURBODRILL WITH A REDUCED DRILLING FLUID PRESSURE ON A FLOATING PISTON

[75] Inventors: Masauemon Kajikawa; Akio Ota, both of Komatsu, Japan

[73] Assignee: Kabushiki Kaisha Komatsu Seisakusho, Tokyo, Japan

[21] Appl. No.: 485,624

[22] Filed: Apr. 18, 1983

[51] Int. Cl.[3] ..... E21B 4/02

[52] U.S. Cl. ..... 175/107; 415/502

[58] Field of Search ..... 175/107, 228; 415/502, 415/170 R

[56] References Cited

U.S. PATENT DOCUMENTS

| | | | |
|---|---|---|---|
| 3,659,662 | 5/1972 | Dicky | 175/107 |
| 3,741,321 | 6/1973 | Slover, Jr. et al. | 175/40 |
| 3,882,946 | 5/1975 | Ioannesian et al. | 415/502 X |
| 4,114,703 | 9/1978 | Matson, Jr. et al. | 175/107 |
| 4,225,000 | 9/1980 | Maurer | 175/107 |

*Primary Examiner*—James A. Leppink
*Assistant Examiner*—Thuy M. Bui
*Attorney, Agent, or Firm*—Frost & Jacobs

[57] ABSTRACT

A turbodrill of the type having an annular floating piston between a tubular housing and a bit drive shaft for bounding the top of a lubricant chamber and the bottom of a drilling fluid chamber. The lubricant chamber contains oil for lubricating a bearing supporting the drive shaft in the adjacency of its bottom end. The drilling fluid chamber receives a fraction of drilling fluid (i.e. mud) from a turbine located higher in the housing. For making the mud pressure in the drilling fluid chamber approximately equal to the mud pressure in the drill hole (annulus) around the turbodrill, a seal is provided which restricts the influx of the mud from turbine to drilling fluid chamber. Further a passageway is formed through the housing for placing the drilling fluid chamber in constant fluid communication with the annulus.

3 Claims, 3 Drawing Figures

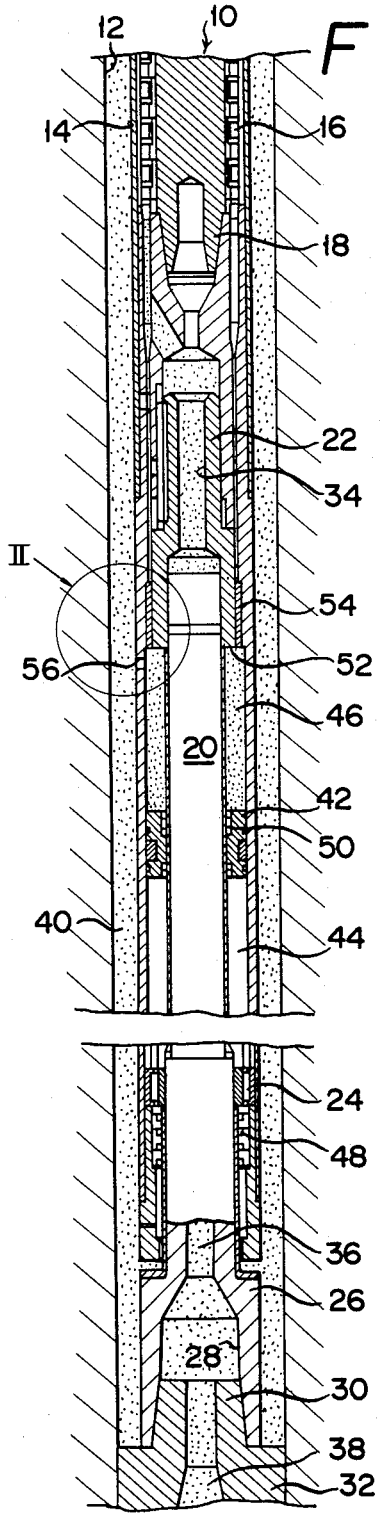
FIG. 1
FIG. 2
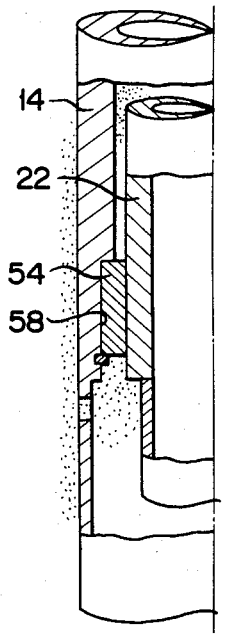
FIG. 3
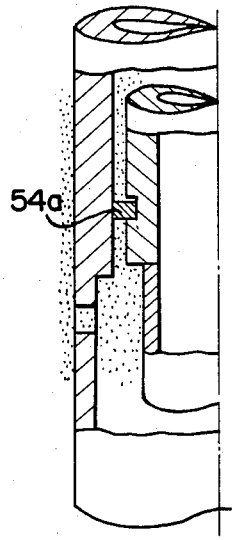

TURBODRILL WITH A REDUCED DRILLING FLUID PRESSURE ON A FLOATING PISTON

BACKGROUND OF THE INVENTION

Our invention pertains to a turbodrill, or a turbine-operated rotary tool used principally in drilling oil or gas wells, and to certain improved features therein.

Turbodrills in general consist of two basic components: (1) a turbine; (2) a lower bearing; and connected to a drill bit. All but the drill bit of these components are enclosed in what is essentially a single tubular housing. The turbine is mud operated. The mud is pumped into the turbine. The turbine has stators on the housing and rotors on a rotor shaft. The stators function to divert the mud flow onto the rotors, causing the latter to rotate with the rotor shaft and hence with the drill bit connected thereto via a hollow, elongate drive shaft. After actuating the turbine the mud flows through the hollow in the drive shaft and emerges from the drill bit to remove the cuttings out of the drill hole and to cool the bit.

In the turbodrill of the above general configuration it has been known to provide a lubricant chamber just above the lower bearing supporting the drive shaft. The lubricant chamber contains a lubricant, usually oil, for lubricating the lower bearing. The top of the lubricant chamber is bounded by an annular floating piston slidably mounted between drive shaft and housing. The floating piston also forms the bottom of a mud chamber into which there is directed part of the mud that has been used for actuating the turbine. The pressure of the mud in the mud chamber acts on the floating piston to pressurize the lubricant in the lubricant chamber.

A problem with the prior art is that the mud pressure in the mud chamber is considerably more than the mud pressure in the annulus, or the drill hole around the turbodrill. This pressure differential constantly acts, via the floating piston, the lubricant in the lubricant chamber, and the lower bearing, on a seal or seals around the drive shaft which are positioned below the lower bearing to bound the lower end of the lubricant chamber. Consequently the seal or seals under the lower bearing have had to be of highly pressure-proof, costly design for withstanding the pressure differential between mud chamber and annulus.

Another fault of the noted prior art arises by reason of the fact that the mud contains, of course, abrasive sands and other solids. Such abrasive particles deposit on the floating piston, resulting in a rapid failure of the seal or seals between piston and drive shaft.

SUMMARY OF THE INVENTION

Our invention makes possible, in a turbodrill of the kind under consideration, the use of a less pressure-proof, far more inexpensive seal or seals than heretofore for sealing the gap between drive shaft and housing under the lower bearing. Our invention also provides a solution as to how to protect the seal or seals between floating piston and drive shaft from the abrasive action of the drilling fluid or mud.

According to our invention, stated in brief, an improved turbodrill is provided which comprises a seal acting between the turbodrill housing and the rotary shaft means therein, in a position at the top end of the drilling fluid chamber, for restricting the inflow of the drilling fluid from the turbine, located higher in the housing, to the drilling fluid chamber. Further the housing has a passageway formed therethrough for establishing fluid communication between the drilling fluid chamber and the outside of the housing.

Once the turbodrill passes below the wellhead in use, it is constantly flooded with the mud that has passed through the tool and which has emerged from the drill bit for the removal of the cuttings. The passageway formed through the housing in accordance with our invention places the drilling fluid chamber in communication with the mud-filled annulus. Moreover, since the seal at the top end of the drilling fluid chamber limits the inflow of the mud from the turbine, the mud pressure in the drilling fluid chamber approximately equals the mud pressure in the annulus. Accordingly no substantial pressure differential develops across the floating piston dividing the drilling fluid chamber and the lubricant chamber from each other.

An advantage gained by our invention briefly summarized above is that the sealing means between drive shaft and housing, positioned under the lower bearing, can be of relatively low pressure-withstanding capacity. The restriction of the mud passage from the turbine to the drilling fluid chamber by the seal offers the additional advantage of reducing the rate of deposition of abrasive solids from the mud onto the floating piston. The seals inside the piston can thus be protected from rapid wear or destruction.

The above and other features and advantages of our invention and the manner of attaining them will become more apparent, and the invention itself will best be understood, from a study of the following description of a preferred embodiment, and of the appended claims, taken together with the attached drawings.

BRIEF DESCRIPTION OF THE DRAWINGS

FIG. 1 is a fragmentary axial section, partly broken away for illustrative convenience, through a preferred form of the turbodrill incorporating the novel concepts of our invention, the turbodrill being herein shown in the act of drilling a hole in the ground;

FIG. 2 is an enlarged fragmentary view, partly in elevation and partly in axial section, of that part of the turbodrill which is shown enclosed in the circle designated II in FIG. 1;

FIG. 3 is a view similar to FIG. 2 but showing a slight modification of the FIGS. 1 and 2 embodiment.

DESCRIPTION OF THE PREFERRED EMBODIMENT

The turbodrill is very long in comparison with its width or diameter. In FIG. 1, therefore, we had to omit substantial portions of the turbodrill. It will nonetheless be seen from the following description that the showing of FIG. 1 contains all the parts of the tool essential for a full understanding of our invention.

Generally designated 10, the turbodrill is shown drilling a hole or well 12. The turbodrill 10 has a tubular housing 14. Although in fact the housing consists of several sections in threaded end-to-end connection with each other, it may be thought of as being of one-piece construction for the purposes of our invention. Disposed in the housing 14 is a turbine 16 which is operated by drilling fluid, usually mud, forced into the housing from above. The construction and operation of the turbine can both be conventional. Suffice it to say, therefore, that the turbine includes a rotor shaft 18 which is mounted concentrically in the housing 14 and which is rotated relative to the housing by the energy of the mud flow through the turbine.

The rotor shaft 18 is rigidly coupled to a hollow drive shaft 20 via a hollow connector shaft 22. All these shafts 18, 20 and 22 are coaxial. A bearing 24 rotatably supports the drive shaft 20 in the adjacency of the bottom end of the housing 14. The drive shaft 20 extends out of the housing 14 and terminates in an enlargement 26. The bottom end enlargement 26 of the drive shaft has a socket 28 for receiving and firmly engaging a connector portion 30 of a drill bit 32. Thus, as the rotor shaft 18 rotates, so does the drill bit 32 for drilling the hole 12 in the ground.

After driving the turbine 16 the mud under pressure mostly flows through the hollow 34 in the connector shaft 22, the hollow 36 in the drive shaft 20, and an internal passageway 38 in the drill bit 32 and so exits into the annulus 40 around the tool. The stream of drilling mud, thus constantly traversing the turbodrill during its operation, is effective to cool the drill bit 32 and to carry the cuttings upwardly through the annulus 40 onto the ground surface.

Slidably mounted between housing 14 and drive shaft 20, an annular floating piston 42 divides the tubular space therebetween into a lower, lubricant chamber 44 and an upper, drilling fluid chamber 46. The floating piston 42 forms the top of the lubricant chamber 44 whereas its bottom is defined by sealing means 48 positioned just below the bearing 24. The lubricant chamber 44 contains a fluid lubricant for constantly flooding and lubricating the bearing 24. The floating piston 42 has several sealing rings 50 mounted on its inside surface for relative sliding engagement with the drive shaft 20.

The drilling fluid chamber 46, on the other hand, has its top bounded by the bottom end 52 of the connector shaft 22 and by a seal 54 between this connector shaft and the housing 14. The seal 54 functions to limit the influx of the drilling mud from the turbine 16 to the drilling fluid chamber 46.

Our invention also features a passageway 56 formed radially through the housing 14 in the vicinity of the top end of the drilling fluid chamber 46. The passageway 56 places the drilling fluid chamber 46 in constant fluid communication with the annulus 40. Thus the mud pressure in the drilling fluid chamber 46 substantially equals the mud pressure in the annulus 40.

As illustrated on an enlarged scale in FIG. 2, the seal 54 can take the form of a tube closely engaged in an annular recess 58 in the inside surface of the housing 14. The inside surface of the tubular seal 54 slidably engages the connector shaft 22, thus acting as a labyrinth seal to limit the passage of the drilling mud therethrough. Alternatively, as shown in FIG. 3, a sealing ring **54*a* or a stack of such sealing rings can be used in place of the tubular seal 54. It is self-evident, however, that the tubular seal 54 of FIG. 2 has a higher sealing capacity than the sealing ring 54*a* of FIG. 3**.

Thus, in accordance with our invention, the seal 54 or **54*a* and the passageway 56 coact to maintain the mud pressure in the drilling fluid chamber 46 approximately equal to the mud pressure in the annulus 40 during operation of the turbodrill 10. Since no substantial mud pressure acts on the floating piston 42, the sealing means 48 bounding the bottom end of the lubricant chamber 44 can be of relatively low pressure-withstanding design and so of low cost. The leakage of the lubricant from the chamber 44 is also reduced. Further, since the deposition of abrasive solids on the floating piston 42 is curtailed because of the limited influx of the drilling mud from the turbine 16, the sealing means 50** on the piston are not to suffer rapid wear or easy destruction.

While we have shown and described our invention in terms of but one embodiment and a slight modification thereof, it will be understood that they are illustrative only and not to be taken as a definition of the scope of our invention. Various modifications and alterations will occur to one skilled in the art within the scope of our invention as expressed in the claims which follow.

We claim:

1. A turbodrill having rotary shaft means supported within a tubular housing and having a lower end extending therefrom for carrying a drill bit, a turbine within the housing for imparting rotation to the drill bit via the shaft means by being actuated by the flow of drilling fluid therethrough, a bearing rotatably supporting the shaft means adjacent said lower end thereof, seal means positioned below said bearing between said shaft means and said housing, and a floating piston positioned between the shaft means and the housing and defining an upper end of a lubricant chamber for containing a lubricant for lubricating the bearing, the floating piston also defining a lower end of a drilling fluid chamber above and opposed to the lubricant chamber for receiving part of the drilling fluid from the turbine, second seal means positioned between the shaft means and the housing above said drilling fluid chamber for restricting the inflow of the drilling fluid from the turbine to the drilling fluid chamber; and means defining a passageway through the housing for communicating the drilling fluid chamber with the outside of the housing; whereby the pressure of the drilling fluid in the drilling fluid chamber acting on the floating piston is made approximately equal to the pressure of the drilling fluid outside the housing.

2. The improved turbodrill as set forth in claim 1, wherein said second seal means is in the form of a tube.

3. The improved turbodrill as set forth in claim 1, wherein said second seal means is in the form of a ring.

* * * * *